United States Patent [19]

Lamon et al.

[11] 4,266,475

[45] May 12, 1981

[54] POSITIONING MECHANISM FOR CALENDER ROLLS

[75] Inventors: David E. Lamon; Paul J. Klemmer, both of Appleton, Wis.

[73] Assignee: Appleton Machine Company, Appleton, Wis.

[21] Appl. No.: 97,347

[22] Filed: Nov. 26, 1979

[51] Int. Cl.[3] ..... B30B 3/04; B30B 15/16

[52] U.S. Cl. ..... 100/168; 100/47; 100/163 A; 100/170

[58] Field of Search ..... 100/47, 163 R, 163 A, 100/168, 169, 170; 72/232, 234

[56] References Cited

U.S. PATENT DOCUMENTS

| | | | |
|---|---|---|---|
| 3,013,526 | 12/1961 | Crumrine et al. | 100/168 X |
| 3,584,570 | 6/1971 | Sass et al. | 100/163 |
| 3,777,656 | 12/1973 | Muller | 100/47 |
| 3,884,140 | 5/1975 | Christ et al. | 100/163 R |
| 3,884,141 | 5/1975 | Lehmann | 100/163 R |
| 3,948,166 | 4/1976 | Wenzel | 100/163 R |

*Primary Examiner*—Peter Feldman

*Attorney, Agent, or Firm*—McDougall, Hersh & Scott

[57] ABSTRACT

A positioning mechanism for calender machines is disclosed. The mechanism employs an interconnected piston and cylinder arrangement whereby the rolls may be separated quickly and subsequently automatically repositioned. When a paper break occurs or when it is otherwise desired to separate the rolls quickly, the cylinders, by means of a lost motion connection, quickly separate the rolls by a specified amount to prevent damage to the apparatus. A hydraulic circuit maintains the spacing required for the lost motion connection and allows for interchanging of rolls of different diameters.

7 Claims, 8 Drawing Figures

POSITIONING MECHANISM FOR CALENDER ROLLS

BACKGROUND OF THE INVENTION

This invention relates to calenders and super calenders of the type used to finish paper for printing or other applications where a relatively high smoothness is required. In such devices the paper passes between the nip of a number of rollers and by the circumferential friction of the rolls on the paper surface a polishing action is obtained. The rollers are generally arranged in a vertical stack. Iron rolls alternate with paper filled rolls, that is, rolls which are formed by placing a large number of doughnut-like paper disks on a common shaft. These paper filled rolls are largely responsible for the polishing action.

Paper filled rolls are easily damaged in the event that there is a break in the paper web being polished. When the web breaks it bunches and jams between the nips of the rollers causing unevenness on the surface of the paper filled rolls impairing the ability of such rolls to smooth the web evenly.

In an effort to avoid damage to paper filled rolls when the web breaks and to permit adjustment of the spacing between rolls, it is necessary to provide some mechanism for positioning the rolls relative to each other and, in particular, for rapidly separating them in the event of a break in the paper web or similar emergency condition which could damage the rolls. Such systems are known in the prior art and, for example, see U.S. Pat. Nos. 3,777,656, 3,948,166, and 3,584,570 which disclose lifting mechanisms. These references are discussed more fully in the Prior Art Statement submitted with this application and hereby incorporated by reference. Although lifting mechanisms are known, none of them has the capability of rapidly separating the rolls in the event of an emergency condition and the capability of automatically repositioning the rolls to their correct operative positions particularly when a worn paper roll has been replaced with a new roll of a different diameter.

It is accordingly an object of the invention to provide an improved positioning mechanism for calender rolls which is capable of accomplishing rapid separation of the rolls in an emergency situation.

A further object of the invention is to provide a device of the type described capable of automatically repositioning the rolls in their proper operative relation regardless of changes in the roll diameter of the rolls in the calender stack.

A further object of the invention is to provide a hydraulic cylinder lifting mechanism for a super calender which utilizes a lost motion connection to rapidly space the rolls one from the other in an emergency situation by an amount determined by the lost motion elements.

A further object of the invention is to provide a hydraulic lowering mechanism for a calender stack which can rapidly separate the rolls in the stack by a preset amount to limit damage to the rolls in the event of a paper break.

Other objects and advantages of the invention will be apparent from the remaining portion of the specification.

DETAILED DESCRIPTION

Figure 1:
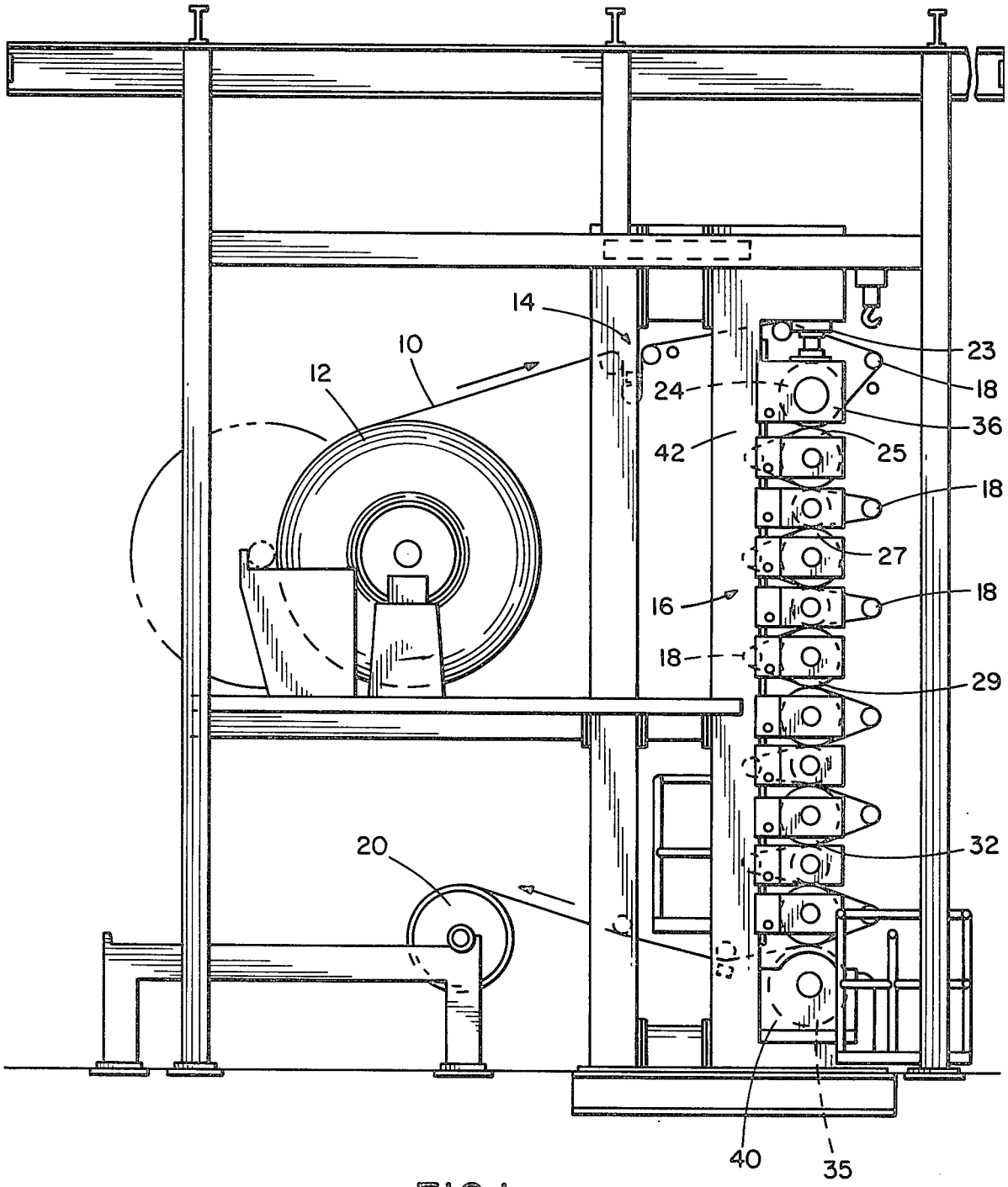
FIG. 1 is a side elevation view of a super calender having the positioning mechanism according to the invention provided therein.
Figure 2:
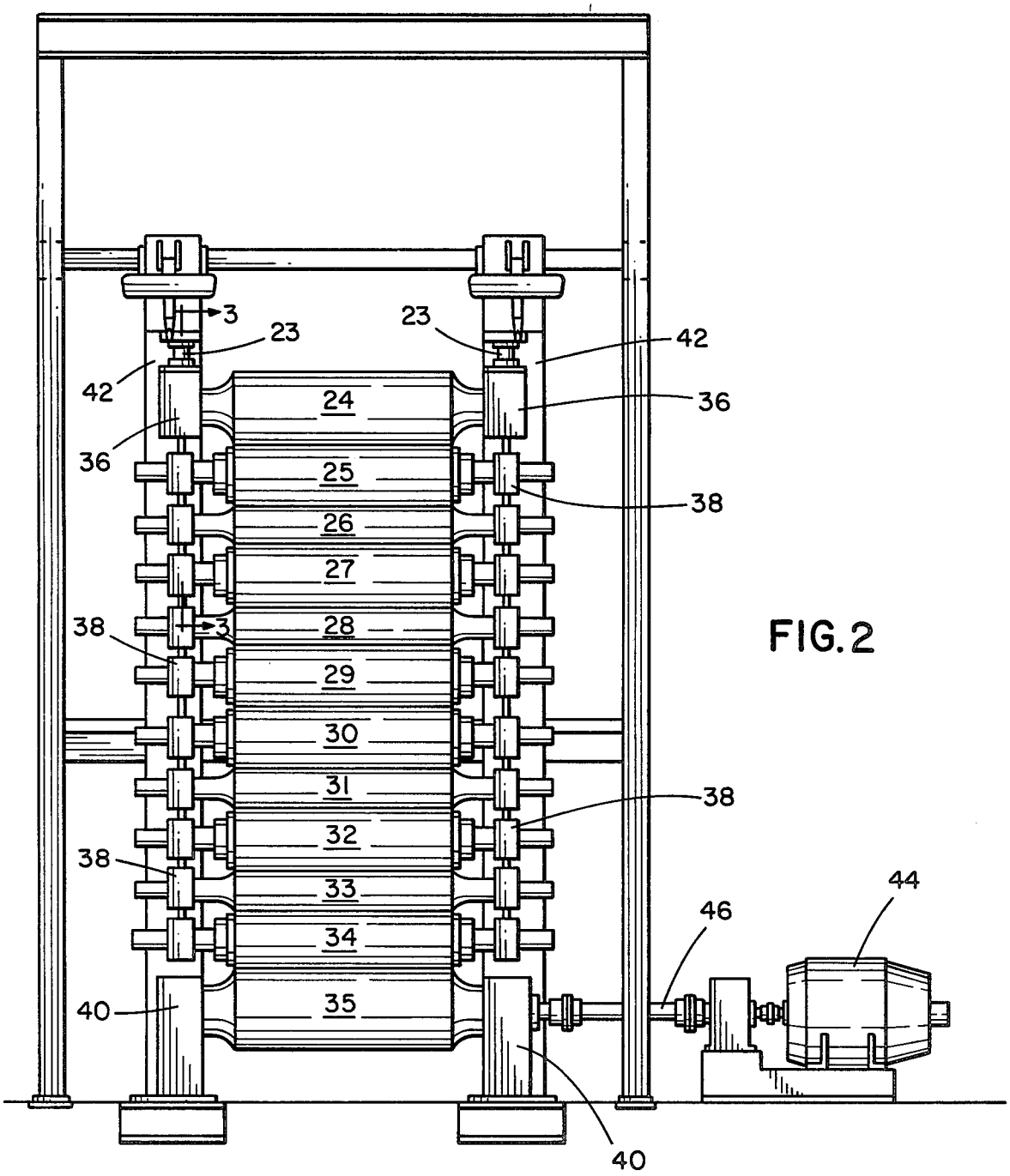
FIG. 2 is a front elevation of the super calender of FIG. 1.

Referring to FIGS. 1 and 2, a super calender machine for imparting a smoothness to the surfaces of a paper web is illustrated. The web 10 is drawn from a roll 12 and passes through tension sensing rollers 14 to a stack of calender rollers generally indicated at 16. The web 10 passes back and forth between the nips of the rollers, one of which is driven with the resulting friction accomplishing the polishing action in a manner well known to those skilled in the art. Fly rolls 18 are provided to correctly position the paper web for passage between the nips of the calender rolls. The calender roll stack is formed of a combination of iron and paper filled rolls, the number and location of each type being a function of the type of paper, the smoothness desired and similar considerations. In any case, a number of paper filled rolls will be included in the stack and are subject to uneven wear or damage in the event of a break or jam in the web 10.

After passing through the nip of the bottommost pair of rollers the web leaves the calender stack and is wound onto a take up reel 20.

To detect web jams and breaks, simple detection mechanisms can be employed as, for example, an electric eye to detect a paper break. If desired, a plurality of such detectors may be employed. In the event of a break or jam, it is necessary to rapidly separate the rolls, one from the other, to avoid damaging the paper filled rolls. During normal operation the rolls are under pressure by virtue of hydraulic cylinders 23. When a break occurs, cylinders 23 must remove pressure from the rollers and begin lifting them in a manner to be described. Simultaneously, a bottom roll is rapidly lowered allowing the remaining rolls to drop downwardly and separate until subsequently lifted by hydraulic cylinders 23. If the separation occurs quickly enough the paper web will not wedge between the nips of the rollers and damage the paper filled rolls.

Figure 3:
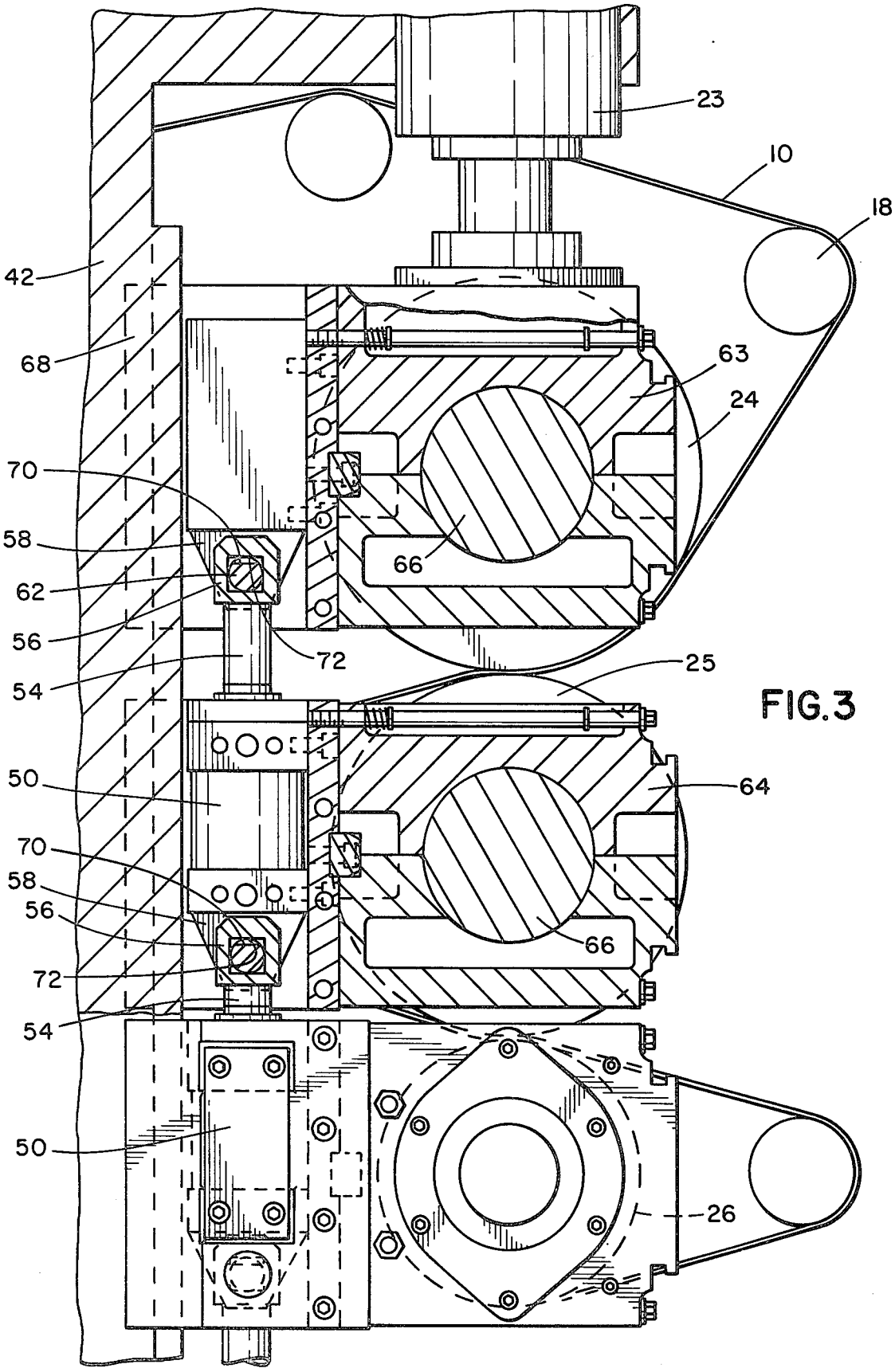
FIG. 3 is a sectional view along the lines 3—3 of FIG. 2 illustrating the construction details of the mechanism according to the invention in the lowered position.

FIGS. 2 and 3 illustrate a plurality of calender rolls 24 through 35 in a vertical stack. The rolls are mounted on either end thereof to mounting elements 36 in the case of the topmost roll, elements 38 in the case of the intermediate rolls and to elements 40 in the case of the bottom roll. The mounting elements, except element 40, are slidably secured to vertical support columns 42 on eiher end of the rolls permitting the rolls to be moved vertically, as desired, to separate the rolls or place them in contact for calendering. The uppermost roll 24 is connected to the load and lift cylinders 23 via the mounting elements 36. Mounting elements 38 are connected to the elements immediately above it in the stack by means of a piston and cylinder arrangement to be described in connection with FIG. 3. The bottommost roll 35 is, however, not connected to other rolls. Instead, it is mounted for movement toward and away from the remaining rolls in the stack by elements 40 described in connection with FIGS. 6 and 7. A motor 44 drives bottom roll 35 via a shaft 46 to accomplish the calendering process in the usual manner.

Referring to FIG. 3, the mounting elements forming an integral part of the lifting mechanism of the invention are illustrated. As seen in FIG. 3, the web 10 passes a first carrying roll 18 and then between the nip of the topmost roll 24 and the roll 25. In the illustrated embodiment roll 24 is preferably an iron roll while roll 25 is a paper filled roll. As the paper passes between the nip a polishing action occurs. As the paper continues on its tortuous path through the nips of the various rolls, additional polishing of both sides of the web is accomplished.

In order to regulate the polishing action, it is necessary that the rolls be properly compressed during operation of the super calender. The bottom roll 35 is placed in the operative position (FIG. 2) and then the lift and load cylinders 23 apply pressure to the roll stack until the desired nip pressure is obtained. In order to compress the rolls, they must be free to move on the vertical column 42.

The mounting elements according to the invention include a plurality of hydraulic cylinders 50 which are interconnected one to the other. Each cylinder includes an internal piston 52 (FIG. 5) and connected thereto is a piston rod 54 terminating in a rod eye 56. The rod eye has a generally rectangular opening 58′ therethrough. The bottom of the cylinder housing includes a clevis 58 having a generally circular opening designated 60. The piston rod of one cylinder is connected to the clevis 58 of the cylinder immediately above it in the stack by means of a shaft or pin 62 which passes through openings 58′ and 60. The uppermost cylinders associated with roll 25 have their piston rods secured to an opening in the top mounting plate 36.

It will be understood that two sets of cylinders 50 of the type illustrated in FIG. 3 are provided, one set for each end of the rolls 25 through 34. The cylinders 50 are secured to end plates 64 which receive rotatably mounted shafts 66 on which the rolls are provided. A portion of the end plates 64 are received in a channel 68 in the vertical columns 42 whereby vertical movement of the calender rolls in the stack is obtained.

An important aspect of the present invention is the manner in which the cylinders 50 are interconnected one to the other. The pin 62, preferably cylindrical, has a flat portion 70 thereby reducing its effective diameter in the vertical direction. The pin is maintained in the position indicated in FIG. 3 by a locking arrangement of any suitable type such as a locking plate. Thus, the flat 70 is always facing upward. It must engage the surface 72 of the rod eye before a roll can be lifted from above. The reduction in effective diameter of the pin 62 by providing flat 70 corresponds to a selected distance "d" by which the rolls will be passed when they are separated for emergency purposes (FIG. 4).

This arrangement constitutes a lost motion connection intentionally provided in the stack for the following purpose. When the stack is in the position indicated in FIG. 3 it is being compressed by the load and lift cylinders 23. Should a paper break occur, the load and lift cylinders will cease compressing the rolls and begin lifting the end plates 36 of the uppermost roll. Simultaneously, the bottom roll 35 is rapidly lowered, as will be described, permitting the intermediate rolls to be separated, one from the other, by the amount "d" of the lost motion connections. After separation the lifting cylinders 23 raise the stack in preparation for resumption of super calendering.

Figure 4:
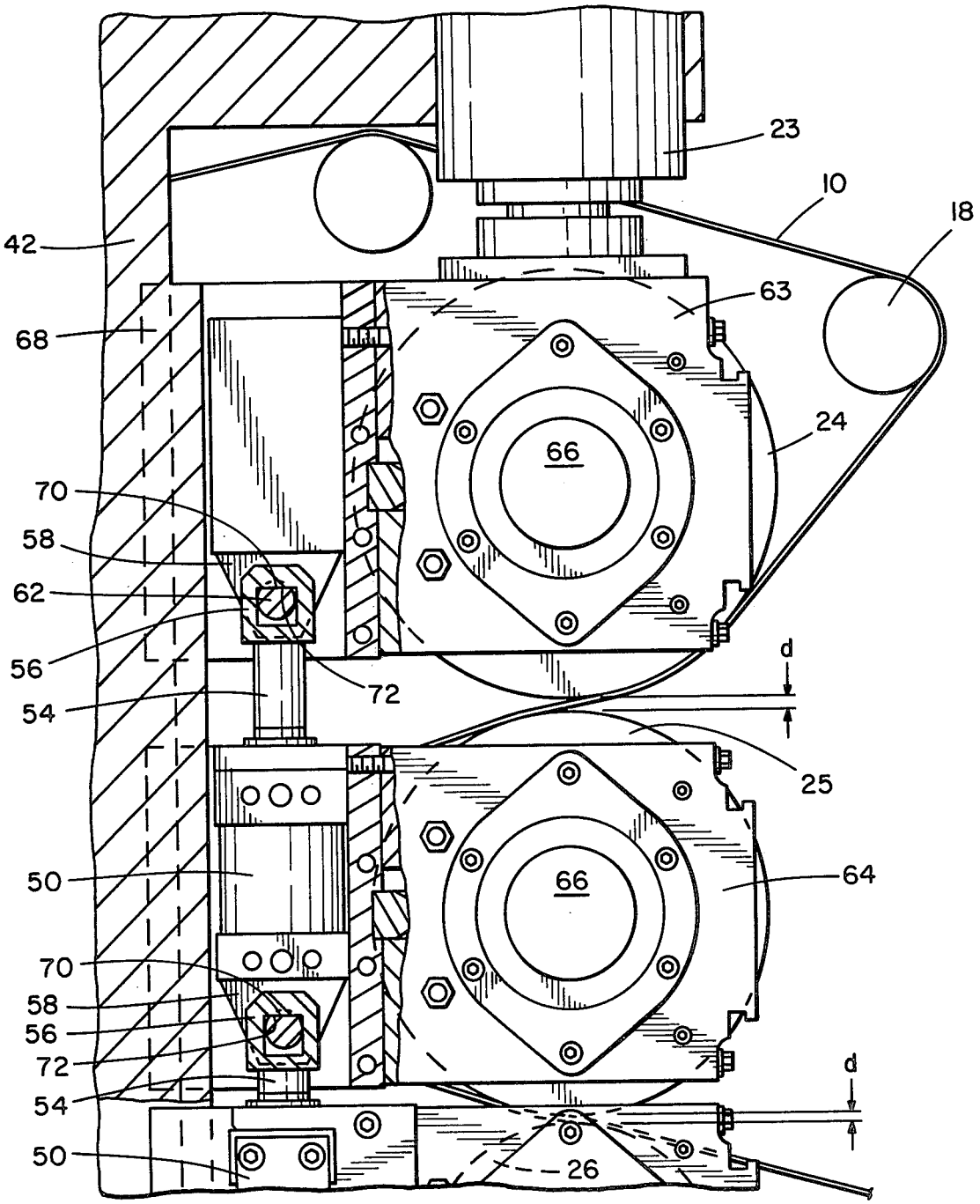
FIG. 4 is a view similar to FIG. 3 illustrating the mechanism in the position in which the rolls are spaced, one from the other.

The result of the separation of the stack is clearly illustrated in FIG. 4. It may be seen that the rod eye associated with each roll is supported on the pin 62 associated with the roll or mounting element next higher in the stack and that each of the illustrated rolls are separated one from the other by a distance "d".

Figure 5:
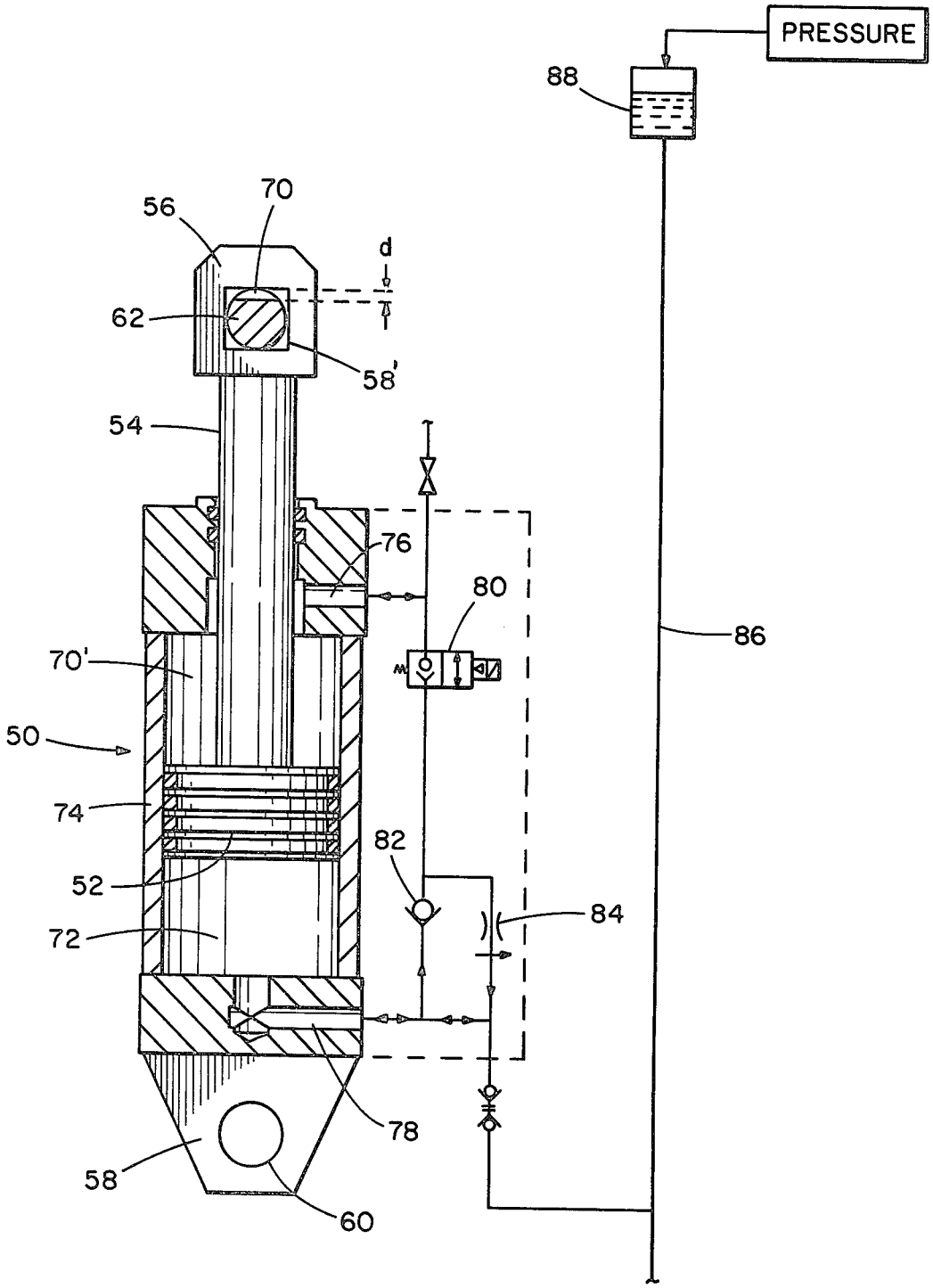
FIG. 5 is a schematic diagram illustrating the operation of the hydraulic circuit for operating the cylinders according to the invention.

Referring now to FIG. 5, a hydraulic circuit for controlling each of the cylinders 50 is schematically illustrated. Cylinder 50 includes an upper oil chamber 70′, a lower chamber 72 with piston 52 being vertically displaceable to alter the dimensions of chamber 70′ and 72 thereby to move the piston rod 54 relative to the cylinder housing 74. The upper chamber 70′ includes an oil passage 76 while the lower chamber is provided with a passage 78. Oil is supplied to the chambers by means of the hydraulic circuit schematically indicated.

The circuit includes a solenoid valve 80 connected to the hydraulic line supplying fluid to the upper chamber 70′, a check valve 82 and a flow regulating valve 84 in parallel therewith. The main oil line 86 supplies make up oil from a reservoir 88.

An important feature of the invention is the pressurizing of the make up oil reservoir 88. This may be accomplished using air pressure on the reservoir. Alternatively, a low pressure hydraulic pump can be employed and, in that case, reservoir 88 is unnecessary. The pressure is low, for example, 50 psi, although this value is dependent upon the size and operating characteristics of the cylinders. The pressure applied to the reservoir is solely to prevent the weight of the rod and piston assembly from eliminating the gap "d" between the pin 62 and the rod eye 56. When the rolls are lowered to their operating positions the pistons are free to move. Nevertheless, it is desired that the gaps "d" be maintained against the weight of the piston rods. The pressure applied on the oil line 86 forces enough oil into the lower oil chambers 72 to maintain these gaps.

Operation of the lifting mechanism of the present invention is as follows. Assuming that the rolls are separated due to an emergency, such as a paper break, the solenoid valves 80 will be closed and the pistons locked in place. This situation remains until the load and lift cylinders raise the rolls fully. Valves 80 then open sequentially lowering the rolls beginning with rolls 34. Lowering continues until all the pistons are at the top of the cylinders. In this state roll change outs can be made as, for example, where a roll is worn or damaged and needs to be replaced or the equipment can be turned off without danger of causing flat spots on the rolls. The valve 80 is then closed again.

When it is desired to begin the calendering operation the rolls are placed in compression. The closed solenoid valves 80 permit oil to flow from the lower chamber 72 to the uppe chamber 70′ via check valve 82 and the check valve portion of valve 80. Thus, roll 34 engages the bottom roll 35 and displaces oil from chamber 72 into chamber 70'. A similar operation is then performed in sequence for each of the rolls in the stack working from the bottom to the top. In this manner the stack is automatically adjusted for the current roll diameter. No manual adjustment of mechanical elements is required.

When the rolls are in contact with each other they are ready to be compressed to a desired value. The pressure from oil line 86 maintains sufficient upward force on the piston 52 to insure that the gaps "d" between the pin and rod eye are maintained. When the process is complete the stack appears as illustrated in FIG. 3.

To separate the rolls the process is reversed. During normal lifting the load and lifting cylinders 23 merely lift the top roll 24 which separates rolls 24 and 25 by the amount of the gap "d" and so on down the stack. In the case of a separation due to a paper break, etc., the bottom roll 35 is dropped by the mechanism illustrated in FIGS. 6 and 7 rapidly separating the intermediate rolls one from the other by the amount of the lost motion connection. Simultaneously, the cylinder 23 begins the normal lifting process.

Figure 6:
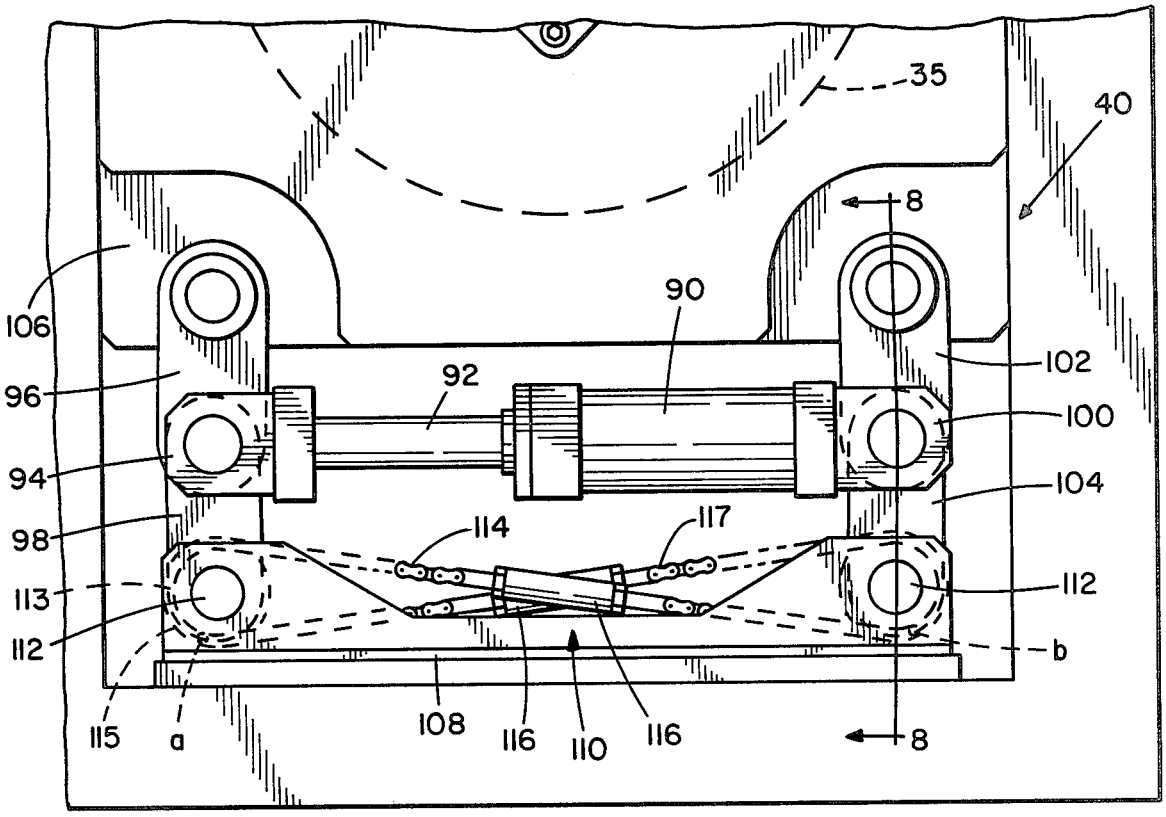
FIGS. 6 and 7 are side elevational views of the bottom portion of the super calender illustrating the bottom roll support mechanism in its raised and lowered positions, respectively.
Figure 7:
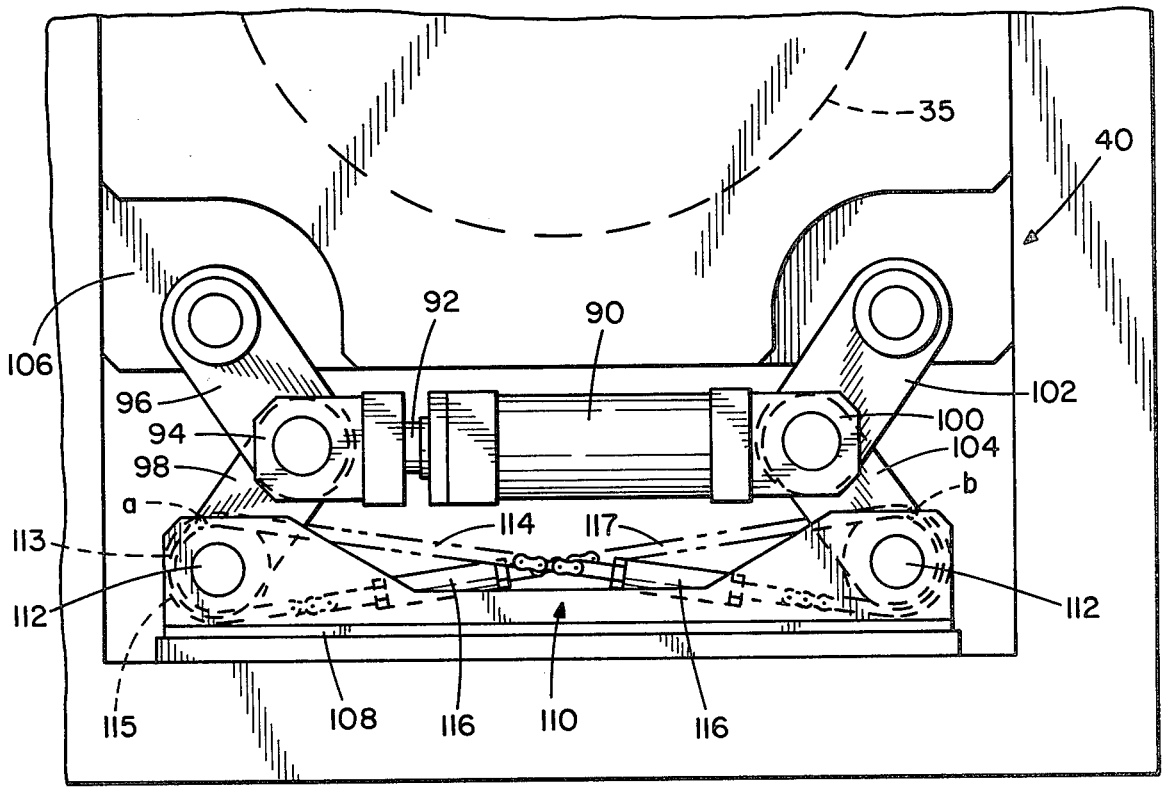
Figure 8:
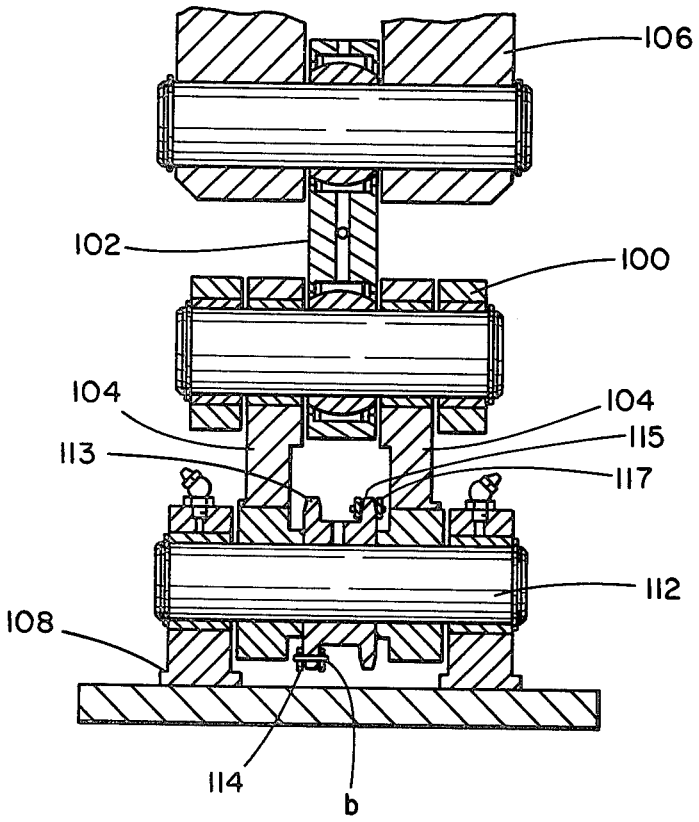
FIG. 8 is an end sectional view along the line 8—8 of FIG. 6.

Referring now to FIGS. 6 and 7, the mounting elements 40 for the roll 35 are illustrated. The mounting assembly supports the bottom roll 35 and moves it between raised and lowered positions. FIG. 6 illustrates the raised position while FIG. 7 illustrates the lowered position. The mounting elements include a cylinder 90 having a piston rod 92. A clevis 94 is pinned to a pair of links 96 and 98. Similarly, a cylinder clevis 100 is pinned to a pair of links 102 and 104. As can be seen by comparing FIGS. 6 and 7, when the piston is in an extended position relative to the cylinder the link pairs are in a substantially vertical position, slightly over center, maintaining the bottom roll bearing housing 106 and the associated support structure in a raised position. The over center position maintains the raised position even in the event of hydraulic pressure loss. As shown in FIG. 7, when the piston is retracted the links move inwardly lowering the bearing housing and support assembly. As indicated in the drawings, the links connect the bearing housing 106 with a support base 108.

In order to maintain the roll 35 level, it is necessary to insure that the links on each side move by an equal amount. For that purpose the roller chain arrangement indicated at 110 is provided. Pinned to the connection 112 between the bottom links and the base 108, for movement therewith, are sprocket wheels 113 and 115. A first roller chain 114 is pinned to the sprockets 113 and tension and link position are adjusted by turn buckle 116. Similarly a second roller chain 117 is pinned to sprockets 115. When the cylinder 90 is actuated to raise or lower the bottom roll 35, the chain arrangement requires that both link pairs must move up or down by an equal amount thereby maintaining the roll in the proper position.

As previously indicated, during normal operation the bottom roll is maintained in the raised position illustrated in FIG. 6 whether or not the remaining rolls in the stack are separated. In the event of an emergency as, for example, a paper break, the cylinder 90 retracts the piston lowering the bottom roll 35, which is a driven roll. This permits rapid separation of the rolls as previously described herein.

While we have shown and described embodiments of this invention in some detail, it will be understood that this description and illustrations are offered merely by way of example, and that the invention is to be limited in scope only by the appended claims.

We claim:

1. A mechanism for vertically positioning a stack of calender rolls relative to a support frame, each roll being mounted to the frame for movement in the vertical direction comprising:

(a) means for lifting and lowering the top roll of said stack, (b) means for lifting and lowering the bottom roll of said stack, (c) means for interconnecting the remaining rolls of said stack, one to the other and to said top roll for movement with the latter, said interconnecting means including:

(i) piston and cylinder assemblies associated with each of said remaining rolls, (ii) a lost motion connecting means for interconnecting said assemblies one to the other and to said top roll, (d) means for controlling operation of said assemblies to permit or prevent movement of the pistons relative to the cylinders, whereby when the pistons are permitted to move the remaining rolls may be sequentially lowered and automatically positioned in contact with each other and said top and bottom rolls, and when the pistons are prevented from moving, the rolls may be rapidly separated, one from the other, by a distance determined by the lost motion connecting means by lowering said bottom roll.

2. The mechanism of claim 1 wherein said lifting and lowering means includes: a pair of hydraulic piston and cylinder assemblies connecting the top roll to the frame for vertical movement toward and away from the remaining rolls.

3. The mechanism of claim 1 wherein said pistons have rods attached thereto, said lost motion connecting means including:

(a) a rod eye secured to each of said piston rods, (b) a flange secured to each cylinder, said flange having an opening therein, (c) a plurality of pin means for pinning the rod eye of one assembly to the flange of one of the adjacent assemblies, said pin means dimensioned to permit a predetermined amount of movement or lost motion during movement of the rolls before causing each rod eye to move with the flange to which it is pinned, whereby the rolls can be rapidly separated one from the other by lowering said bottom roll.

4. The mechanism of claim 3 wherein said pin means is a substantially cylindrical pin received in said rod eye and flange opening, said pin having a flat on one portion thereof, thereby to reduce its effective diameter, said flat determining the amount of movement or lost motion permitted by said lost motion connecting means.

5. The mechanism of claim 3 wherein said controlling means includes means for maintaining the lost motion spacing between said pin means and said rod eye when said pistons are permitted to move during movement of the rolls into contact with each other.

6. The mechanism of claim 1 wherein said bottom roll lifting and lowering means includes:

(a) a bottom roll support, (b) a base, (c) two pairs of links, each pair connecting said support to said base whereby said support may be raised and lowered relative to said base by angular movement of said links, (d) cylinder and piston means connected to both pairs of links for controlling the angular movement of said links.

7. The mechanism of claim 6 wherein said moving means further includes:

(a) sprocket wheels connected to one link of each pair, (b) roller chains entrained over the sprocket wheels to cause both link pairs to be equally displaced by said cylinder and piston means, whereby the bottom roll support is maintained level.

* * * * *